US006604977B2

(12) United States Patent
Saito et al.

(10) Patent No.: US 6,604,977 B2
(45) Date of Patent: Aug. 12, 2003

(54) WOBBLING TOY AND WOBBLING TOY SET

(75) Inventors: Shinya Saito, Tokyo (JP); Kaoru Igarashi, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 09/840,150

(22) Filed: Apr. 24, 2001

(65) Prior Publication Data

US 2001/0044253 A1 Nov. 22, 2001

(30) Foreign Application Priority Data

May 16, 2000 (JP) ..... 2000-143501
May 16, 2000 (JP) ..... 2000-143502

(51) Int. Cl.[7] ..... A63H 33/26; A63H 3/46; A63H 3/16

(52) U.S. Cl. ..... 446/136; 446/375; 446/97

(58) Field of Search ..... 446/129, 131, 446/132, 133, 134, 135, 136, 137, 138, 139, 375, 376, 381, 383, 97, 437; 273/359, 366, 367, 368, 369, 370; 40/406, 426

(56) References Cited

U.S. PATENT DOCUMENTS 2,645,879 A 7/1953 Richter
2,645,880 A 7/1953 Richter
3,775,900 A 12/1973 Thorn et al. ..... 46/120
4,031,660 A * 6/1977 Chen ..... 446/132
5,301,444 A * 4/1994 Horiuchi ..... 40/406
5,335,917 A * 8/1994 Kuna ..... 273/445
5,463,826 A * 11/1995 Horiuchi ..... 40/426
5,595,141 A * 1/1997 Udelle et al. ..... 446/134
5,857,430 A * 1/1999 Griffiths ..... 119/256
5,957,745 A 9/1999 Johnson et al. ..... 446/234
6,062,938 A * 5/2000 Meng-Suen ..... 40/426
6,131,318 A * 10/2000 Hsieh ..... 40/406
6,322,415 B1 * 11/2001 Cyrus et al. ..... 446/130

FOREIGN PATENT DOCUMENTS

| | | |
|---|---|---|
| DE | 1097875 | 1/1961 |
| EP | 0641580 A1 | 3/1995 |
| EP | 1157724 A1 * | 11/2001 |
| FR | 2597002 | 10/1987 |
| GB | 2155345 | 9/1985 |

* cited by examiner

*Primary Examiner*—Jacob K. Ackun
*Assistant Examiner*—Faye Francis
(74) *Attorney, Agent, or Firm*—Staas & Halsey LLP

(57) ABSTRACT

A wobbling toy (20) comprising: a body (21), a shaft (23) attached to the body, and a wheel (24) which is rotatable around the shaft (23), for moving the body, wherein the wheel (24) is attached out of perpendicular to the shaft (23). The wheel comprises a magnet (24*a* and 24*b*) and the wobbling toy can travel by a magnetic force which exerts to the magnet of the wheel.

13 Claims, 10 Drawing Sheets

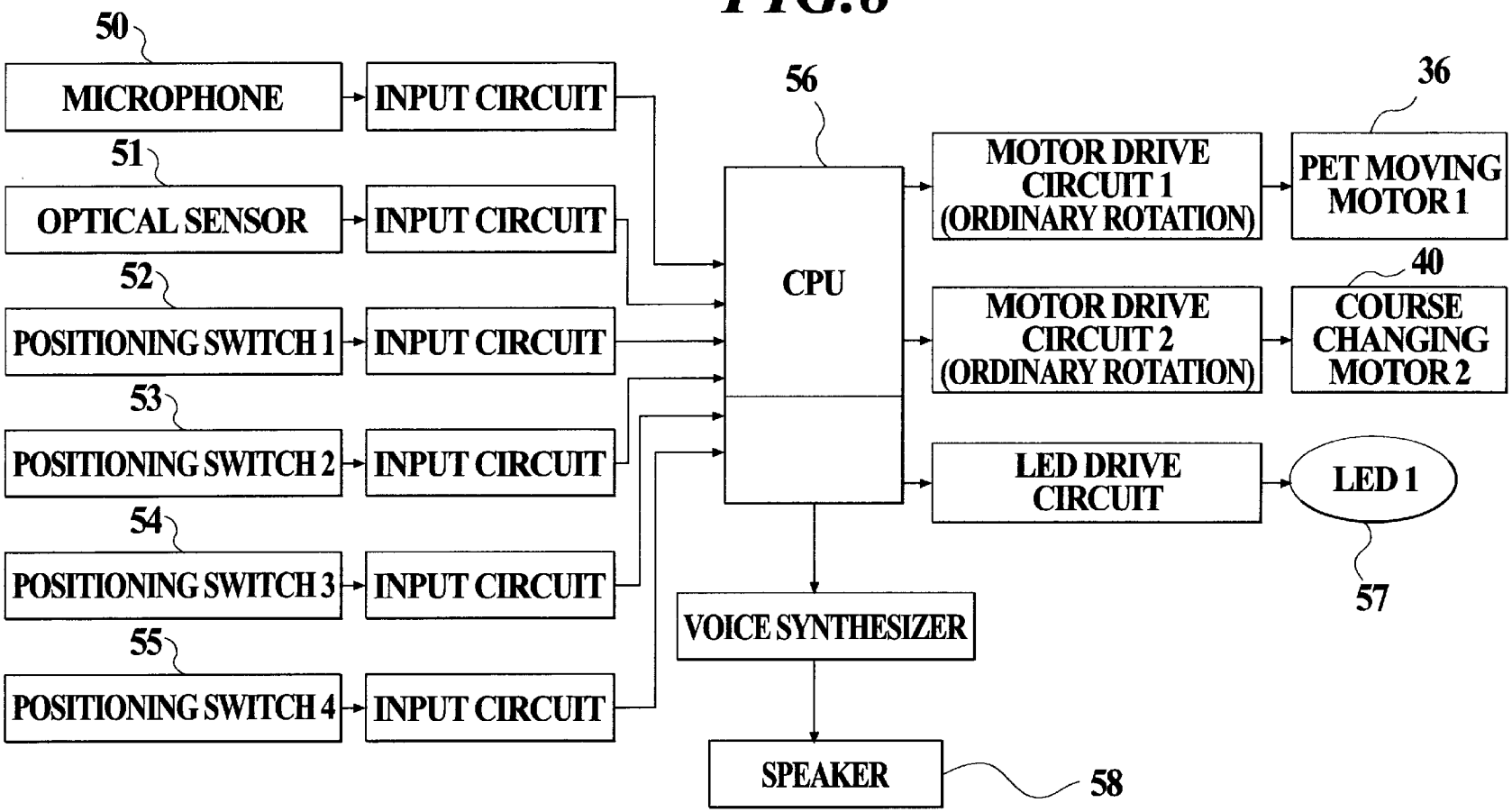
FIG.8
MICROPHONE
50
OPTICAL SENSOR
51
POSITIONING SWITCH 1
52
POSITIONING SWITCH 2
53
POSITIONING SWITCH 3
54
POSITIONING SWITCH 4
55
INPUT CIRCUIT
INPUT CIRCUIT
INPUT CIRCUIT
INPUT CIRCUIT
INPUT CIRCUIT
INPUT CIRCUIT
CPU
56
MOTOR DRIVE CIRCUIT 1 (ORDINARY ROTATION)
MOTOR DRIVE CIRCUIT 2 (ORDINARY ROTATION)
LED DRIVE CIRCUIT
PET MOVING MOTOR 1
36
COURSE CHANGING MOTOR 2
40
LED 1
57
VOICE SYNTHESIZER
SPEAKER
58

WOBBLING TOY AND WOBBLING TOY SET

BACKGROUND OF THE INVENTION

1. Field of the Invention

The present invention relates to a wobbling toy, in particular, to a wobbling toy which moves while wobbling or tottering, and to a wobbling toy set in which a wobbling toy is operated by magnetic force, in particular, to a wobbling toy set in which the wobbling toy takes an interesting or pretty motion.

2. Description of Related Art

As a wobbling toy which moves with a wobbling, for example, a toy moving forward with a wobbling body, which comprises a body having a shape of a small animal, e.g., a cat, a mouse or the like, and right and left legs which are attached to the body and are moved alternately by a driving device, e.g., a cam mechanism, a link mechanism or the like, which is housed in the body, is known.

Such a wobbling toy is different from one such as a car toy which runs linearly or curvedly, and has the advantage that it can show charm or prettiness like a real small animal by a wobbling of the body. However, when the wobbling toy has a construction in which the right and left legs are moved alternately by a conventional driving device, e.g., a cam mechanism, a link mechanism or the like, generally, the legs are mechanical and stiff in those actions. In order to solve for the stiffness or awkwardness of the actions, it may be considered to introduce a driving device having a more precise mechanism, like a use in the field of a precision robot. However, because such a driving device having a more precise mechanism is expensive, it is hard to incorporate such an expensive driving device in such a small toy because a relatively low cost is required in the field of small toy. There are also another problems that in the conventional wobbling toy, the mechanism for having the right and left legs operate alternately is complicated, so that the number of mechanical elements required for the mechanism is large.

As a wobbling toy set in which a wobbling toy member is operated by magnetic force, one comprising a disc plate with an attached magnet which is provided under a floor, and a wobbling toy member which is moved on the upper surface of the floor by magnetic force according to rotation of the disc plate, is known.

However, there is a problem that only rotation of the disc plate gives only a very monotonous motion, i.e., an uninteresting motion, to the wobbling toy member.

SUMMARY OF THE INVENTION

The invention has been made in view of the above problems.

An object of the invention is to provide a wobbling toy which moves with wobbling smoothly.

Another object of the invention is to provide a wobbling toy set having a simple structure, in which the wobbling toy makes an interesting motion.

In accordance with an aspect of the invention, the wobbling toy comprising: a body, a shaft attached to the body, and a wheel which is rotatable around the shaft, for moving the body, wherein the wheel is attached out of perpendicular to the shaft.

For example, the wobbling toy may have a structure to be pushed by hand, a structure to be pulled by using a string or a structure to move by a motor or a power spring. Further, it may have a structure to move by magnetic force, as shown in FIG. 2. It may have any structure so long as the body of the toy wobbles from side to side by rolling of the wheel.

According to such a wobbling toy, because the wheel is attached out of perpendicular to the shaft, the body of the toy wobbles from side to side with rolling of the wheel. Thus, because the wobbling is realized by rolling of the wheel, the wobbling of the body can be carried out smoothly and thereby, for example, a wobbling toy having an imitated shape of a small animal can show charm or prettiness like a real small animal by a smooth wobbling of the body. Even when a driving device for the wheel, e.g., a motor, a power spring or the like, is loaded, the driving device does not require a large size nor a complicated structure.

Preferably, the wobbling toy travels by a magnetic force. According to such a wobbling toy, it is possible to move the toy with wobbling by making a magnetic member or a magnet function from the outside, without a specific driving means for wobbling.

The wheel may comprise a magnet, and the wobbling toy may travel by a magnetic force which exerts to the magnet of the wheel. In order to have a magnetic force on the wobbling toy, for example, another magnetic member or another magnet may be provided to function under the floor.

According to the wobbling toy, it is possible to move the toy with wobbling by the magnetic member or the magnet exerting effect to the magnet of the wheel from the outside.

Preferably, the magnet of the wheel has an S-pole and an N-pole in a thickness direction of the wheel.

When setting the polarities of the magnetic member or the magnet provided under the floor in reverse against that of the magnet of the wheel, the magnet of the wheel follows the movement of the magnetic member or the magnet provided under the floor. When the polarity direction of the magnetic member or the magnet under the floor is reversed, the direction of the wobbling toy on the floor also follows the movement thereof rapidly. Accordingly, for example, a wobbling toy having an imitated shape of a small animal can show charm or prettiness like a real small animal by a smooth wobbling of the body.

The body of the wobbling toy may be divided into a plurality of parts, one of which may be connected with the next part by a pivot, to swing horizontally with respect to the next part. The number of parts may be two or more. The wobbling toy having such a structure is adapted to an imitated wobbling toy of an animal, a vehicle or the like, having a long body, e.g., snake, insect, fish, train, or the like.

According to the wobbling toy having such a structure, when the toy is moved, the body is wobbling while the divided parts swing horizontally with respect to the next part. Accordingly, it enables the wobbling toy to become more amusing.

A projection piece which is made of soft material to swing, may be attached to an outer surface of the body.

The wobbling toy having such a structure is adapted to an imitated wobbling toy of an animal having a long swingable portion, e.g., an insect having long antennas, a rabbit having a pair of long ears, an aquatic animal having barbels or fins, or the like. The projection piece may be made of soft material enough to swing with traveling, for example, paper, resin, rubber or the like.

According to the wobbling toy having such a structure, when the toy is moved, the body is wobbling while the projection piece also swings side to side. Accordingly, it enables the wobbling toy to become more amusing.

In accordance with another aspect of the invention, the wobbling toy set comprises: a wobbling toy member comprising a first magnetic body, and a driving device comprising a wrapping connector driving mechanism having a wrapping member and first and second wrapped members around which the wrapping member is wrapped, wherein a second magnetic body which exerts to the first magnetic body to move the wobbling toy member, is attached to the wrapping member.

The term "wrapping connector driving mechanism" means a mechanism comprising a wrapping member (wrapping connector), and a plurality of rotational wrapped members (wheels) around which the wrapping member is wrapped to transmit the rotational force of one of the wrapped members to the other. The wrapping member is made of a flexible material and can make resistance to a tension, e.g., a belt, a rope chain, rubber or the like.

According to the wobbling toy set, it is possible to move the wobbling toy member in a desired direction by arranging the plurality of rotational wrapped members appropriately. Accordingly, it enables the wobbling toy set to become more amusing.

Preferably, the driving device further comprises a reciprocal motor as a driving source for the wrapping connector driving mechanism.

According to the wobbling toy set having such a structure, because the wrapping member can be rotated reciprocally, it is possible to change the motion of the wobbling toy member. Accordingly, it enables the wobbling toy to become more amusing.

Preferably, the second magnetic body can be turned around a position on the wrapping member according to a change of rotational direction of the wrapping member to change magnetic poles of the second magnetic body.

According to the wobbling toy set having such a structure, because the direction of the magnetic poles of the second magnetic body can be changed according to the change of rotational direction of the wrapping member, at the same time, the direction of the wobbling toy member is also changed. Accordingly, it enables the wobbling toy to become more amusing.

The wrapping connector driving mechanism may further comprise a moving member for moving one of the first and second wrapped members to change a position of the one of the first and second wrapped members with respect to the other.

According to the wobbling toy set having such a structure, it is possible to give a further complicated motion to the wobbling toy member by changing the position of the one of the first and second wrapped members to the other. Accordingly, it enables the wobbling toy to become further more amusing.

In the wobbling toy set, preferably, the wobbling toy member comprises: a body, a shaft attached to the body, and a wheel which is rotatable around the shaft, for moving the body, wherein the wheel is attached out of perpendicular to the shaft.

According to the wobbling toy set having such a structure, because the wheel is attached out of perpendicular to the shaft, the body of the toy member wobbles from side to side with rolling of the wheel. Thus, because the wobbling is realized by rolling of the wheel, the wobbling of the body can be carried out smoothly. Accordingly, it enables the wobbling toy to become more amusing.

The first magnetic body may comprise a magnetic wheel which has an S-pole and an N-pole in a thickness direction thereof, and the second magnetic body may comprise a magnet which has an S-pole and an N-pole in a direction approximately parallel to a surface on which the wobbling toy member travels.

According to the wobbling toy set having such a structure, when setting the polarities of the magnetic member or the magnet provided under the floor in reverse against that of the magnet of the wheel, the magnet of the wheel follows the movement of the magnetic member or the magnet provided under the floor. When the polarity direction of the magnetic member or the magnet under the floor is reversed, the direction of the wobbling toy member on the floor also follows the movement thereof to be reversed. Accordingly, it enables the wobbling toy to become more amusing.

The body of the wobbling toy member may be divided into a plurality of parts, one of which is connected with a next part by a pivot, to swing horizontally with respect to the next part.

According to the wobbling toy set having such a structure, when the toy member is moved, the body is wobbling while the divided parts swing horizontally with respect to the next part. Accordingly, it enables the wobbling toy to become more amusing.

The wobbling toy member may have a shape of an imitated aquatic animal. Because the wobbling toy member moves with wobbling, it is possible to reproduce a motion similar to that of an aquatic animal. Accordingly, it enables the wobbling toy to become more amusing.

In accordance with a further aspect of the invention, the wobbling toy set comprises: a ground plate, a wobbling toy member provided on an upper surface of the ground plate, comprising a body, a shaft attached to the body, and a magnetic wheel which is rotatable around the shaft, for moving the body, wherein the magnetic wheel having an S-pole and an N-pole in a thickness direction thereof is attached out of perpendicular to the shaft, and a driving device provided under the ground plate, comprising a magnetic body which magnetically exerts to the magnetic wheel, and a transport member for transporting the magnetic body along a lower surface of the ground plate and along a desired transportation course.

According to the wobbling toy set having such a structure, because the wheel is attached out of perpendicular to the shaft, the body of the toy wobbles from side to side with rolling of the wheel. Because the wobbling is realized by rolling of the wheel, the wobbling of the body can be carried out smoothly. Further, it is possible to move the toy member with wobbling by making the magnetic body function from the underneath the ground plate.

Preferably, the magnetic body has a direction of N-pole to S-pole which is approximately parallel to the lower surface of the ground plate, and the direction of N-pole to S-pole of the magnetic body can be changed when a transportation direction for the transport member is reversed.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein;

FIG. 8 is a block diagram of a control device according to the embodiment of the wobbling toy of the present invention;

PREFERRED EMBODIMENT OF THE INVENTION

The wobbling toy according to an embodiment of the present invention will be explained with reference to the attached drawings, as follows.

In the embodiment, as the wobbling toy, one in which a fish swims in an aquarium is shown.

The wobbling toy comprises an aquarium 10, a wobbling body 20, and a driving device 30 for operating the wobbling body 20.

Figure 1:
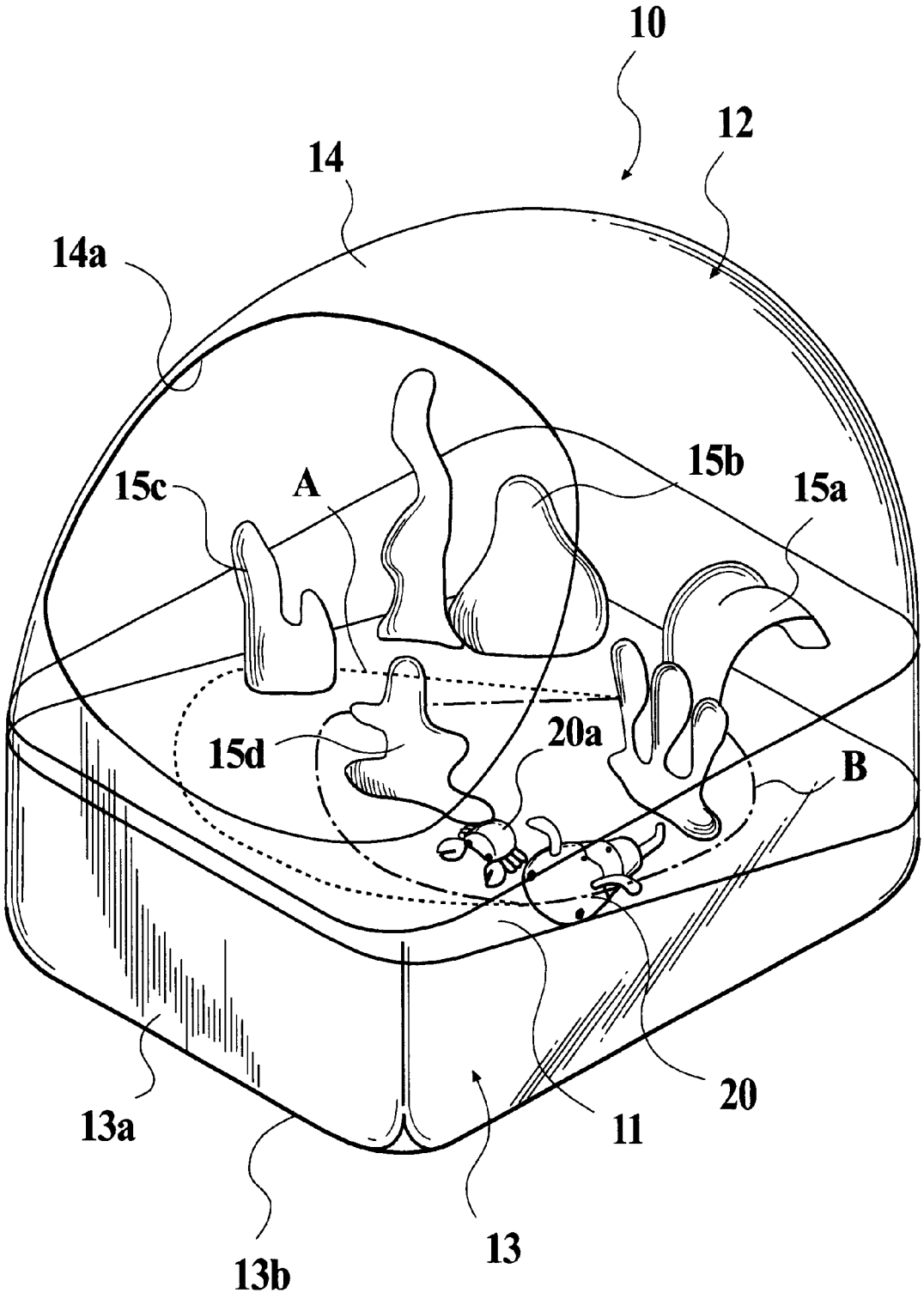
FIG. 1 is a schematically perspective view of an aquarium containing a wobbling toy according to an embodiment of the present invention.

The aquarium 10 is divided into an upper space 12 and a lower space 13 by the boundary of a ground plate (floor plate) 11 which is provided with a slope, as shown in FIG. 1. The wobbling body 20 can move and act in the upper space 12 which is defined by a transparent cover 14. At a portion of the cover 14, an opening 14*a* is formed. The lower space 13 contains the driving device 30 therein and is defined by opaque side walls 13*a* and a bottom plate 13*b*.

On the upper surface of the ground plate 11, various types of accessories 15*a*, 15*b*, 15*c* and 15*d*, e.g., an imitated water grass, an imitated rock or the like, are arranged at suitable positions. One 15*a* of them is used as a home for the wobbling body.

Figure 2:
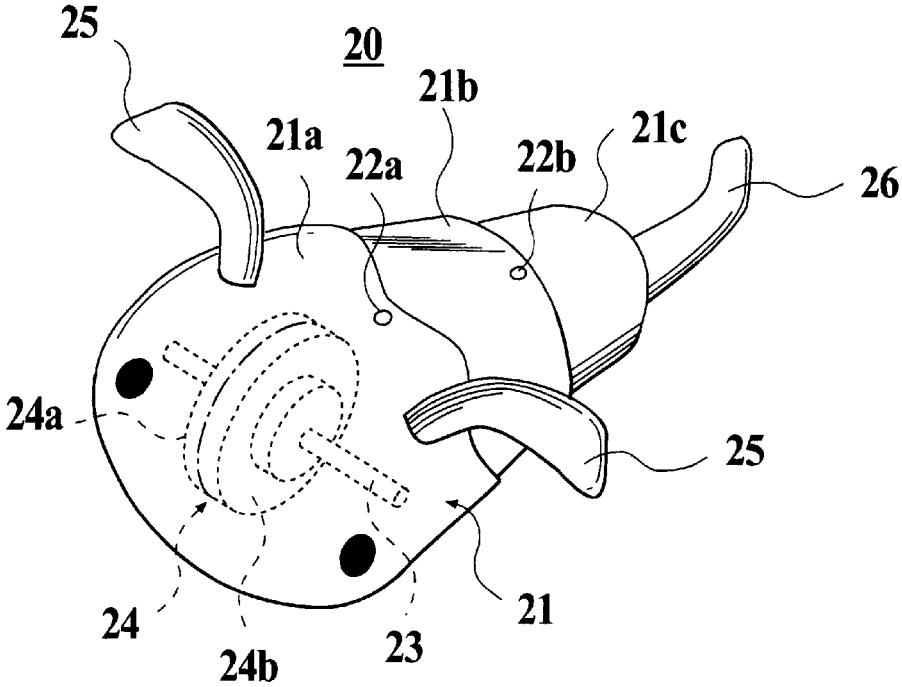
FIG. 2 is a schematically perspective view of a wobbling body of the wobbling toy member according to the embodiment of the present invention.
Figure 3:
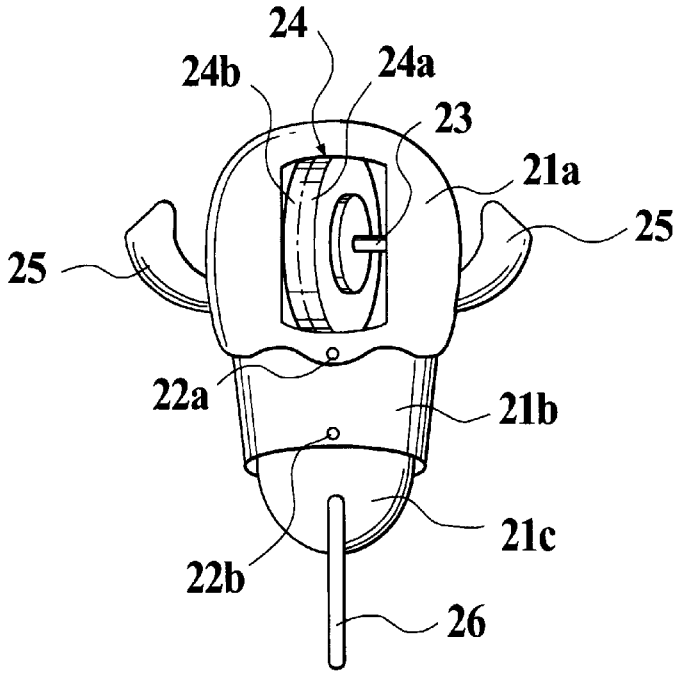
FIG. 3 is a bottom view of the wobbling body for showing the attachment state of a wheel therein.

The wobbling member 20 comprises a main body 21 forming an outer shell thereof. The main body 21 is divided into a front part 21*a* forming the head portion of the wobbling member 20, a central part 21*b* (swinging part) forming the body portion thereof, and a rear part 21*c* (swinging part) forming the bottom portion thereof, as shown in FIG. 2. The central part 21*b* is connected with the front part 21*a* by a first pivot 22*a* which is disposed at a connecting position on the central line of the wobbling member 20 vertically, so that the central part 21*b* can swing horizontally with respect to the front part 21*a* on the first pivot 22*a*. The rear part 21*c* is connected with the central part 21*b* by a second pivot 22*b* which is disposed at a connecting position on the central line of the wobbling member 20 vertically, so that the rear part 21*c* can swing horizontally with respect to the central part 21*b* on the second pivot 22*b*.

In the front part 21*a* forming the head portion, a shaft 23 is disposed laterally (in the width direction of the wobbling member 20) and horizontally, and therefore perpendicular to a vertical plane. On the shaft 23, a wheel 24 is fixed with the surface thereof being inclined a little with respect to the vertical plane perpendicular to the shaft 23. The wheel 24 comprises a magnet which has the S-pole half 24a and the other N-pole half 24*b* in the thickness direction.

On the both side ends of the upper surface of the front part 21*a* in the wobbling member 20, a pair of thin pieces (swinging projections) 25 and 25 which are imitated fins or imitated barbels are provided. On the rear end of the rear part 21*c*, a thin piece (swinging projection) 26 which is an imitated caudal fin is provided.

Figure 4:
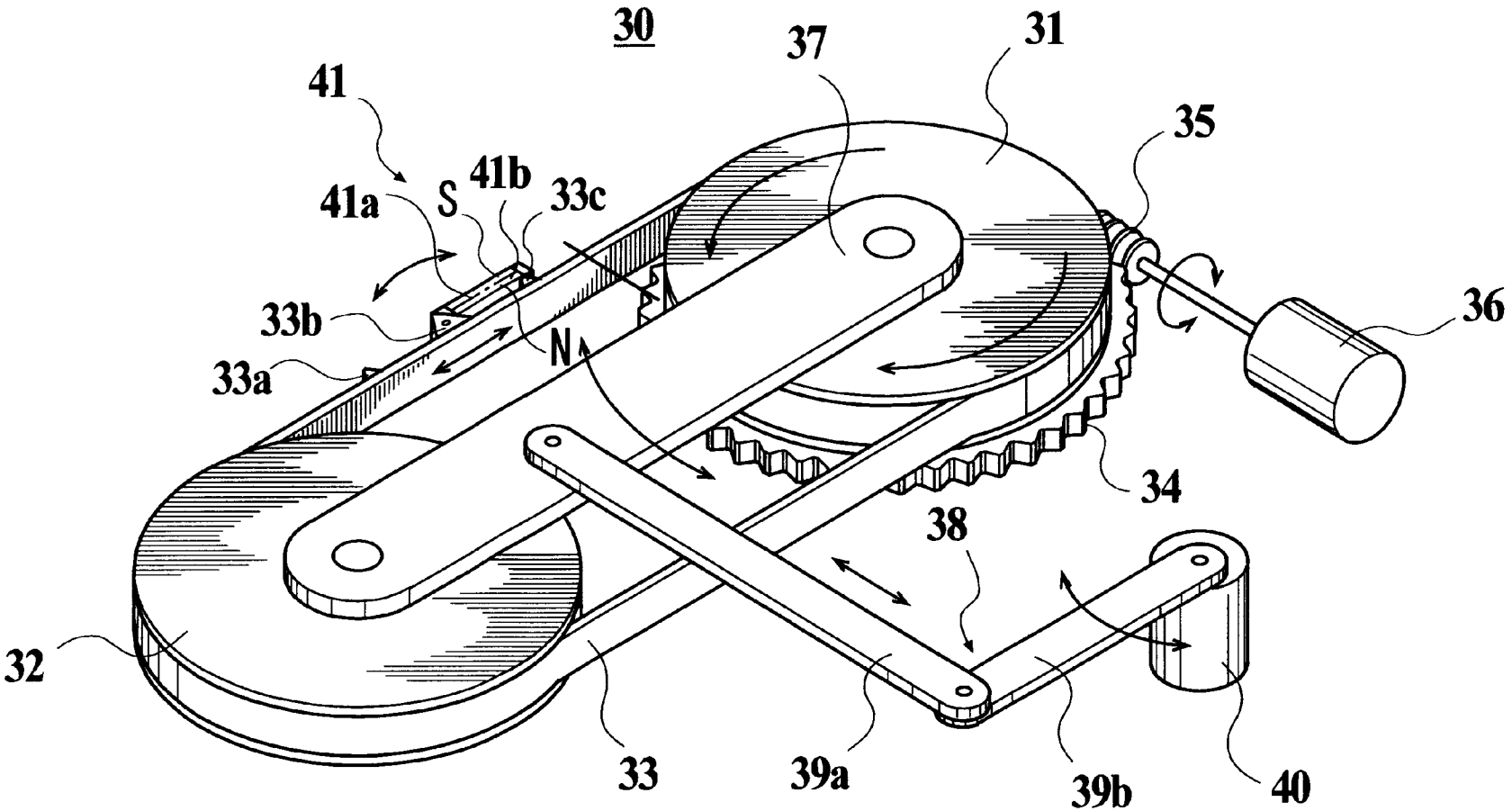
FIG. 4 is a schematically perspective view of a driving device of the wobbling toy member according to the embodiment of the present invention.

The driving device 30 is provided with a driving pulley 31, a driven pulley 32, and a belt 33 which is wrapped around them, as shown in FIG. 4.

To the driving pulley 31, a worm wheel 34 is attached. The worm wheel 34 is connected to engage with a reciprocating motor 36 through a worm 35.

The driving pulley 31 and the attached worm wheel 34 rotate on a shaft which is provided at an end of an arm 37, and the driven pulley 32 rotates on another shaft which is provided at the other end of the arm 37. The driven pulley 32 can be reciprocally swung with the arm 37 with respect to the rotation shaft for the driving pulley 31. The arm 37 is provided with a positioning member 38 for setting the swing angle of the arm. The positioning member 38 comprises a first link 39*a* which has an end connected to the arm 37, a second link 39*b* which has an end connected to the other end of the first link 39*a*, a reciprocating motor 40 which is connected to the other end of the second link 39*b*, and the like.

At predetermined positions on the outer surface of the belt 33, projections 33*a*, 33*b* and 33*c* are formed. At the central projection 33*b*, an end of a magnet 41 is attached so that the magnet 41 can be swung horizontally around the central projection 33*b* reciprocally. The other end of the magnet 41 is placed on one of the end projections 33*a* and 33*c* to keep the position of the magnet 41 stably. The S pole 41*a* and the N pole 41*b* of the magnet 41 are formed that the magnetic field in the magnet is directed to the direction which is approximately horizontal and approximately perpendicular to the attached surface of the belt 33.

In the wobbling toy having such a construction, the driving device 30 is contained in the lower space 13 of the aquarium 10 so that both surfaces of the S and N poles 41*a* and 41*b* of the magnet 41 are in contact with the lower surface of the ground plate 11 of the aquarium 10.

Then, water is poured into the upper space 12 of the aquarium 10 and the wobbling member 20 is put into the water.

When the motor 36 is driven to rotate in a direction, the driving pulley 31 is rotated through the worm 35 and the worm wheel 34, and thereby the belt 33 is rotated. As a result, the magnet 41 attached to the belt 33 is moved in a direction with the belt 33. The movement of the magnet 41 provides a movement of the wobbling member 20 by the magnetic force of the magnet 41 to the magnetic wheel 24 of the wobbling member.

Figure 5:
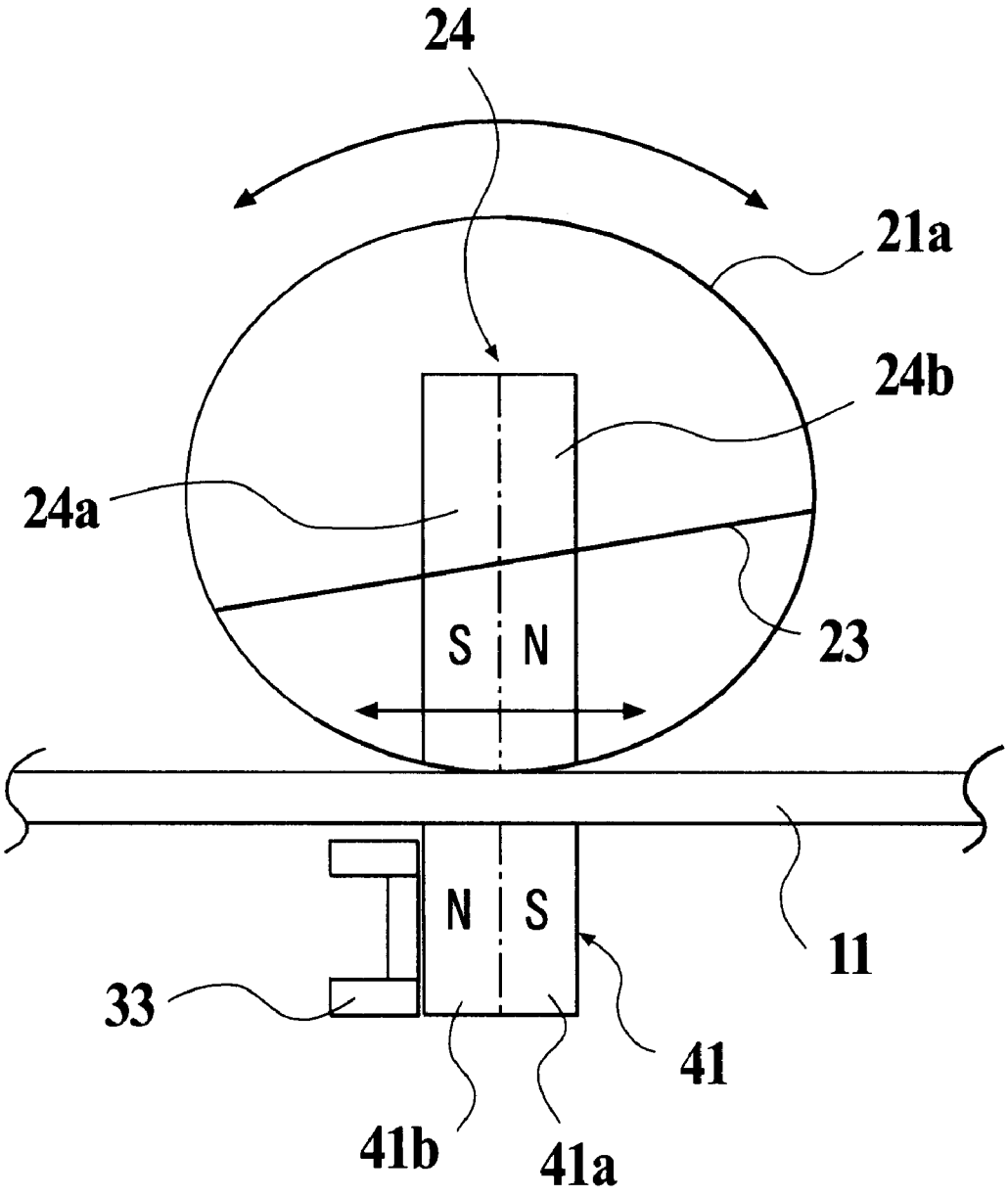
FIG. 5 is a schematic front view for showing the movement of the wobbling body shown in FIG. 2.

On the upper surface of the other end of the magnet 41, a rubber member (not shown) is attached to be in contact with the lower surface of the ground plate 11. Accordingly, when the magnet 41 is moved in a direction, a friction force is given to the rubber member at the other end of the magnet 41 from the lower surface of the ground plate 11. The friction force gives a torque to the magnet 41 to bring the other end of the magnet 41 to the rear, for example, to bring the S pole 41*a* to the outer position with respect to the belt 33, as shown in FIG. 5. Accordingly, the position of the wheel 24 of the wobbling member 20 is determined so that the S pole 24*a* and the N pole 24*b* of the wheel 24 are positioned above the N pole 41*b* and the S pole 41*a* of the magnet 41, respectively, through the ground plate 11. Thus, the position of the wobbling member 20 is determined, for example, so that the front part 21*a* of the wobbling member 20 looks toward the travel direction of the belt 33.

Figure 6A:
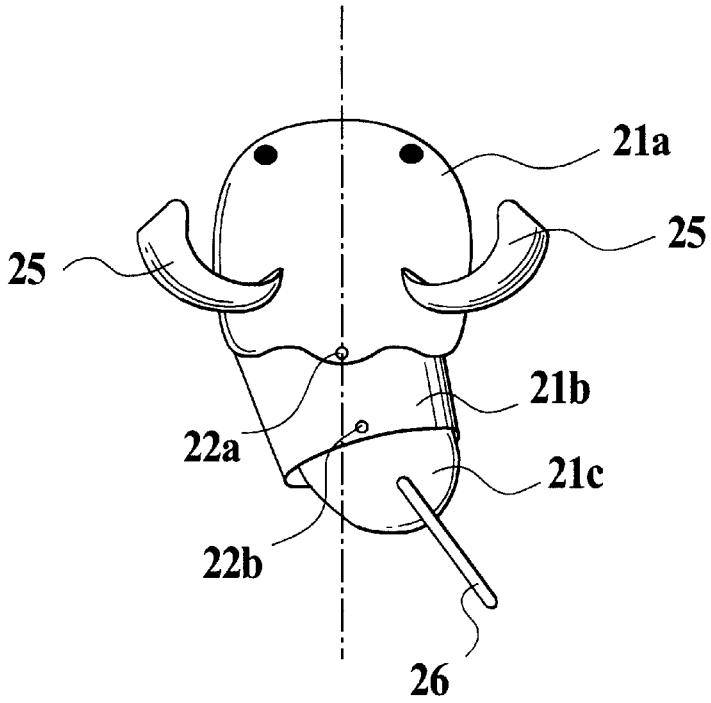
FIGS. 6A and 6B are plan views for showing different movement states of the wobbling body shown in FIG. 2.
Figure 6B:
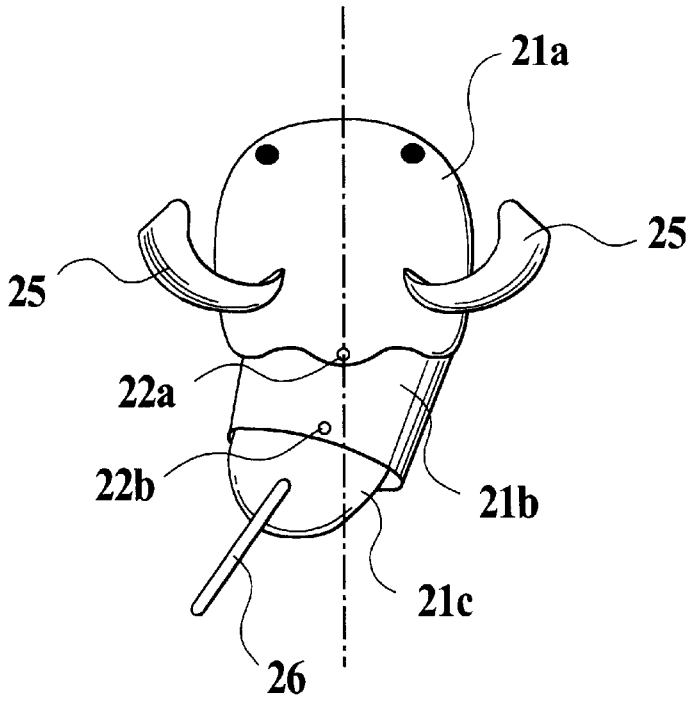

Because wheel 24 is provided with the surface thereof being inclined a little to the plane perpendicular to the shaft 23, the wobbling member 20 swings in the right and left directions according to the rotation of the wheel 24, as shown in FIG. 5. Accordingly, the front part 21*a* forming the head portion of the wobbling member 20 swings in the right and left directions, and thereby other parts 21*b* and 21*c* also swing in the right and left directions, as shown in FIGS. 6A and 6B. In the case, the motion of the other parts 21*b* and 21*c* are retarded than that of the front part 21*a*, by the resistance of water, so that the other parts 21*b* and 21*c* move slowly. According to the motion of the main body 21 of the wobbling member 20, the thin pieces 25 and 26 also swing.

Next, when the motor 36 is driven to rotate in the reverse direction, the belt 33 is moved in the reverse direction. As a result, the magnet 41 is moved in the reverse direction with receiving a friction force given to the rubber member of the magnet 41 from the lower surface of the ground plate 11. The friction force gives a torque to the magnet 41 to bring the other end of the magnet 41 onto the projection 33*a*, that is, to bring the N pole 41*b* to the outer position with respect to the belt 33. Consequently, the wheel 24 comprising the S pole 24*a* and the N pole 24*b* carries out a 180° turn so that the S pole 24*a* and the N pole 24*b* of the wheel 2 position above the N pole 41*b* and the S pole 41*a* of the magnet 41, respectively, through the ground plate 11. Thus, the front part 21*a* of the wobbling member 20 looks toward the travel direction of the belt 33, i.e., the reverse direction.

Thus, the wobbling member 20 moves with wobbling or tottering, corresponding to the movement of the magnet 41 which is attached to the belt 33. Further, the wobbling member 20 goes forward with the head portion turning toward the travel direction of the belt 33.

The route of the magnet 41 is determined by the driving pulley 31 and the driven pulley 32. However, because the driven pulley 32 can be swung around the rotary shaft of the driving pulley 31 by operating the positioning member 38, it is possible to take a desired route of the magnet 41 by using the positioning member 38 appropriately. That is, the route of the magnet 41, e.g., the course "A" which is shown by a dotted line, and the course "B" which is shown by an alternate long and short dash line, in the aquarium 10 shown in FIG. 1, can be set by own free will, by driving to rotate the motor 40 in the normal or reverse direction appropriately, thereby to rotate the arm 37 on the rotary shaft of the driving pulley 31 at a desired angle.

Another wobbling member 20*a* may be arranged in the vicinity of the courses "A" and "B", as shown in the aquarium 10 in FIG. 1, in order to swing the wobbling member 20*a* by the magnet 41 which is attached to the belt 33.

The wobbling member 20*a* is set at a position at which the wobbling member 20*a* can be moved in the direction approximately perpendicular to the traveling direction of the belt 33, as shown in FIG. 7. On the wobbling member 20*a*, a magnet 27 with the S pole 27*a* and the N pole 27*b* is attached. The position of the wobbling member 20*a* is set so that one of the S and N poles 27*a* and 27*b* is faced to the belt 33. In the embodiment of FIG. 7, the S pole 27*a* is faced to the belt 33.

Figure 7A:
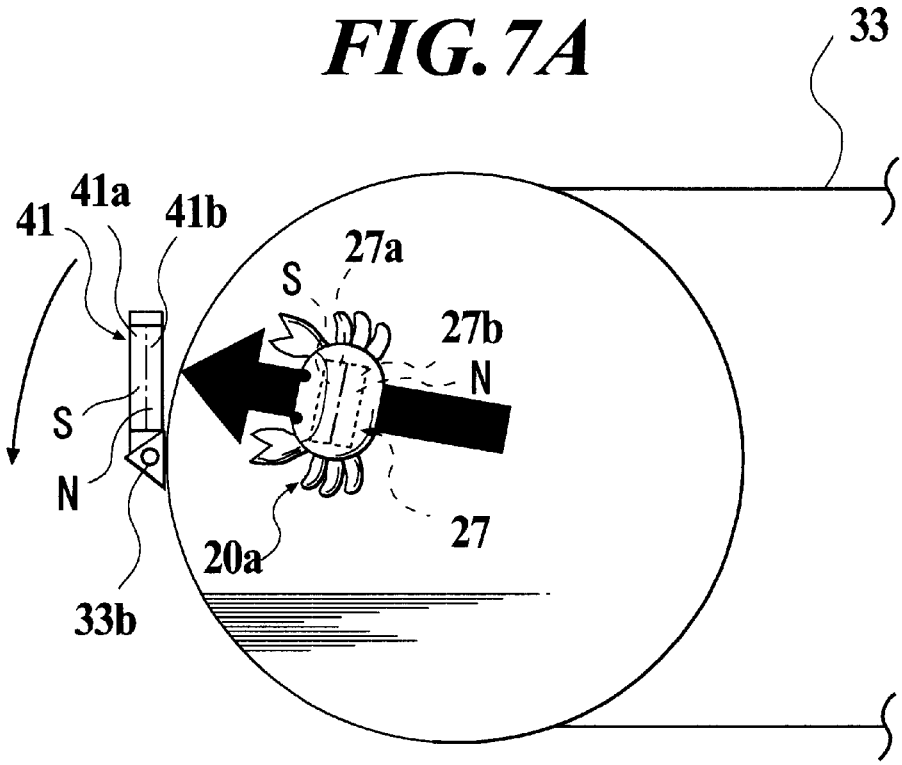
FIGS. 7A and 7B are schematic views for showing movement states of another wobbling body according to the embodiment of the wobbling toy of the present invention.
Figure 7B:
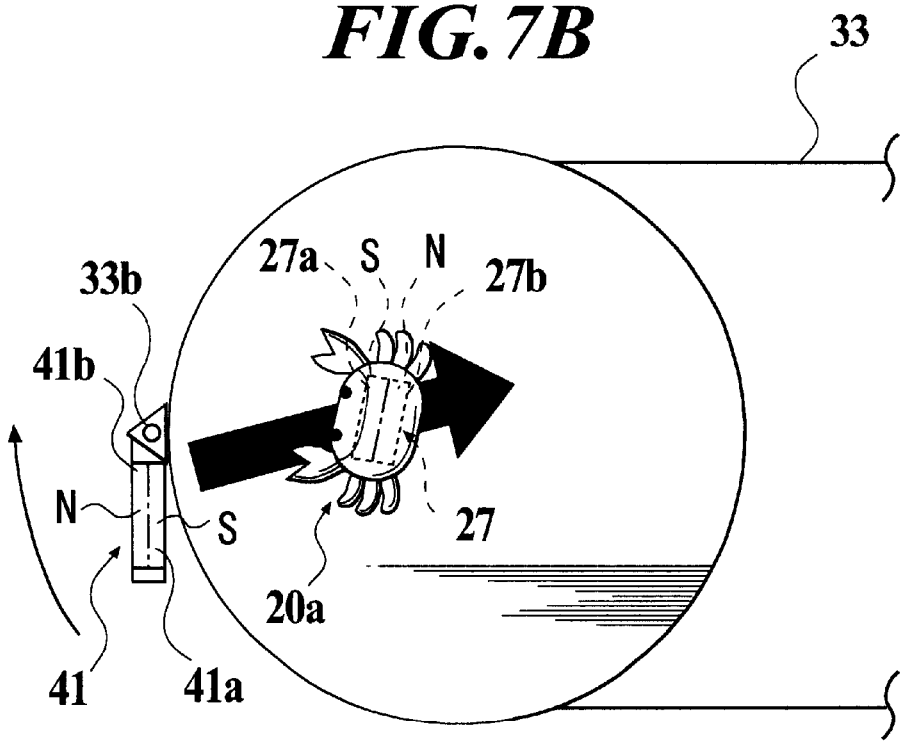

When the belt 33 is rotated in the anticlockwise direction, as shown in FIG. 7A, the free end of the magnet 41 is brought to the rear, to bring the N pole 41*b* to the inner position with respect to the belt 33, by the friction force given to the rubber member of the magnet 41 from the lower surface of the ground plate 11. As a result, the wobbling member 20*a* is attracted to the N pole 41*b* of the magnet 41. On the contrary, the belt 33 is rotated in the clockwise direction, as shown in FIG. 7B, the free end of the magnet 41 is brought to the rear, to bring the S pole 41*a* to the inner position with respect to the belt 33. As a result, the wobbling member 20*a* is separated from the S pole 41*a* of the magnet 41 by the repulsive force of the S pole 27*a* of the magnet 27.

A microphone 50 and an optical sensor 51 are disposed at suitable positions in the aquarium 10, and positioning sensors 52, 53, 54 and 55 for detecting the position of the wobbling toy 20 are disposed at suitable positions on the courses "A" and "B". Each signal output from the microphone 50, the optical sensor 51 and positioning sensors 52, 53, 54 and 55 is sent to a CPU 56. The CPU 56 controls the direction of rotation, the number of revolution and the like, of the motors 36 and 40 in the driving device 30, and puts on or off an LED 57 which is disposed at a suitable position in the aquarium 10, and generates a sound or voice through a speaker 58 which is disposed at a suitable position in the aquarium 10, according to the signals from the microphone 50, the optical sensor 51 and positioning sensors 52, 53, 54 and 55, as shown in FIG. 8. For example, the optical sensor 51 can be used to detect a person coming near the aquarium 10. When a person comes near the aquarium or when the number of a person coming near there reaches a predetermined times, the motion or the sound or voice, of the wobbling member 20 can be changed.

For example, when a light of an electric bulb, a sound or the like is detected in a room, the wobbling member 20 may be returned to its home 15*a*. By detecting the position of the wobbling member 20 by the positioning sensors 52, 53, 54 and 55, it is also possible to change the moving direction of the wobbling member 20. Further, it is possible to put on or turn on or off the LED 57, or to generate a sound or voice through a speaker 58, by a combination of the requirements.

Although some embodiments of the invention have been explained as described above, it should also be understood that the present invention is not limited to the embodiments and that various changes and modifications may be made to the invention without departing from the gist thereof.

For example, only an example in which the wobbling member 20 is entered in the aquarium 10 is shown in the above-described embodiment, it is a matter of course that the wobbling member 20 may be worked in a general container other than an aquarium 10.

In the above-described embodiment, the driving device 30 has a structure in which the driven pulley 32 can be reciprocally swung with the arm 37 with respect to the rotation shaft for the mounted driving pulley 31. However, it may have a structure in which the driving pulley 31 can be reciprocally swung with the arm 37 with respect to the rotation shaft for the driven pulley 32 mounted to the aquarium 10.

Figure 9:
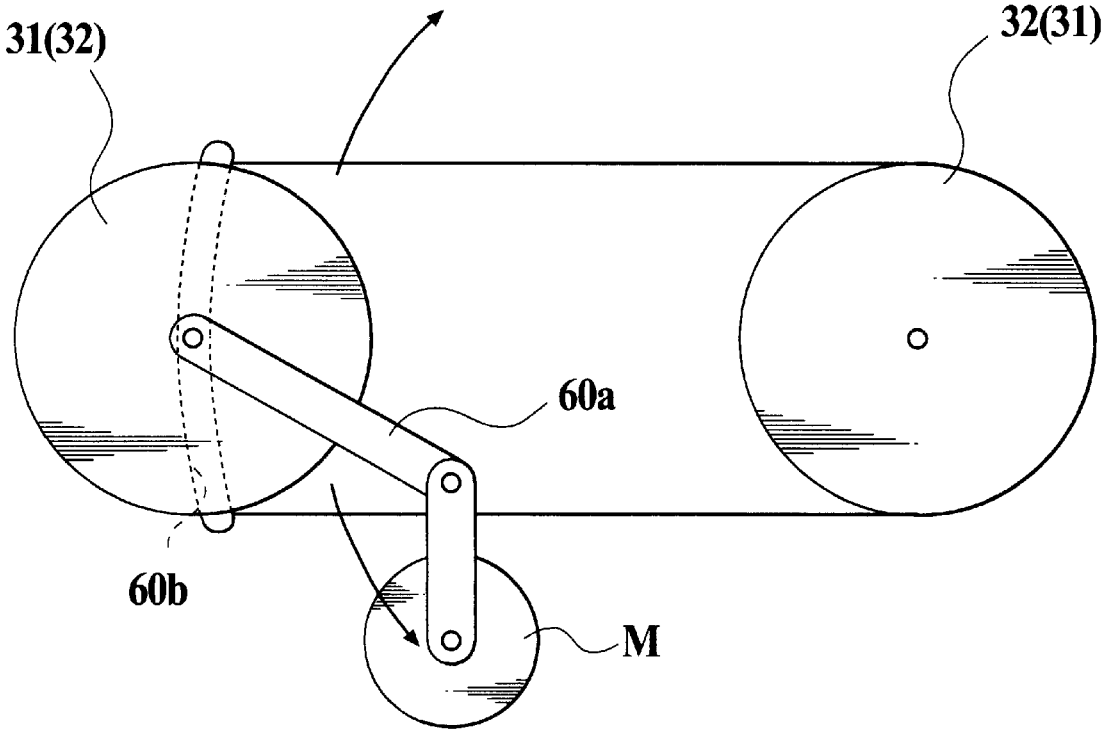
FIG. 9 is a plan view of a driving device according to another embodiment of the wobbling toy of the present invention.

In the above-described embodiment, the driven pulley 32 is held to reciprocally swing on the rotation shaft for the mounted driving pulley 31 through the arm 37. However, it may have a structure in which one of the driving pulley 31 and the driven pulley 32 can be reciprocally swung with respect to the other without through the arm 37, as shown in FIG. 9. In the figure, the driving pulley 31 can be swung along a guide groove 60*b* by a motor M which is a driving source and a link mechanism 60*a* which has an end connected to the motor M and the other end connected to the rotary shaft of the driving pulley 31. The movement of the rotary shaft of the driving pulley 31 is defined by the guide groove 60*b*.

Figure 10:
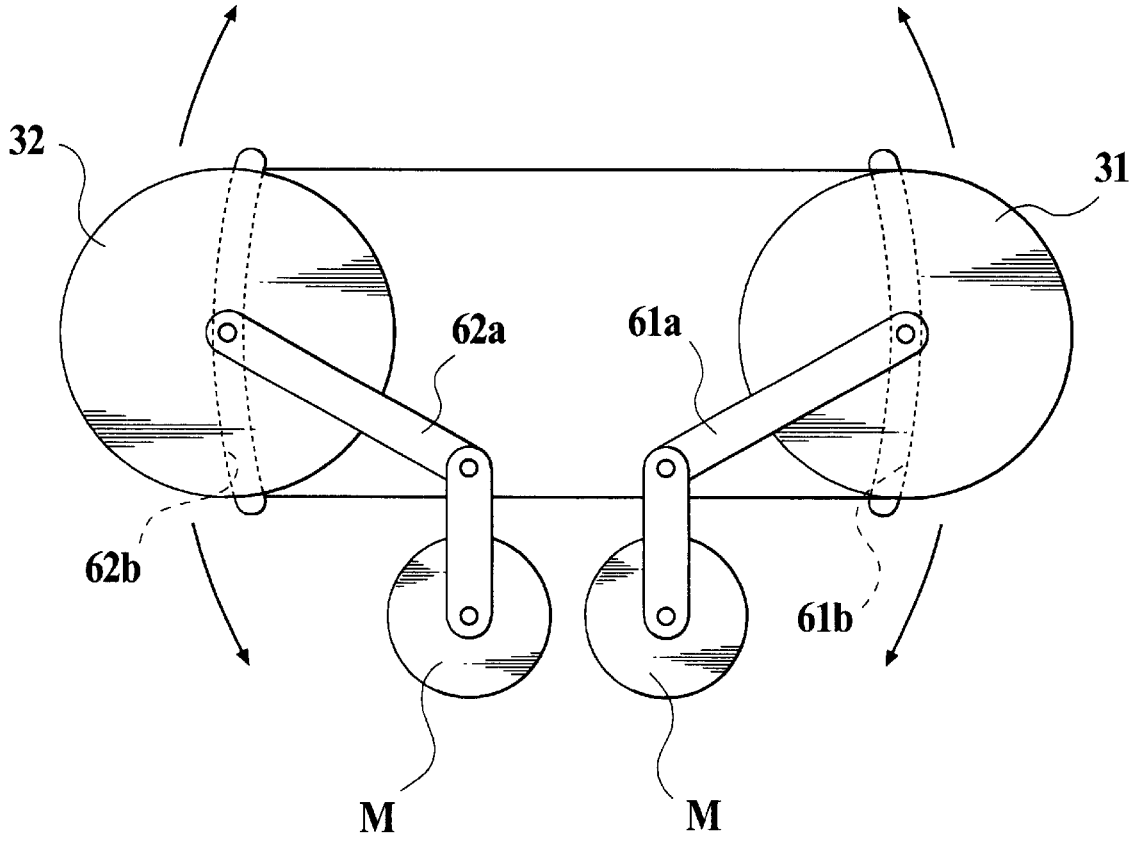
FIG. 10 is a plan view of a driving device according to a further embodiment of the wobbling toy of the present invention.

Further, it may have a structure in which both the driving pulley 31 and the driven pulley 32 can be reciprocally swung without through the arm 37, as shown in FIG. 10. In the figure, the driving pulleys 31 and 32 can be swung along guide grooves 61*b* and 62*b* by motors M and M which are driving sources and link mechanism 61*a* and 62*a*, respectively.

Figure 11A:
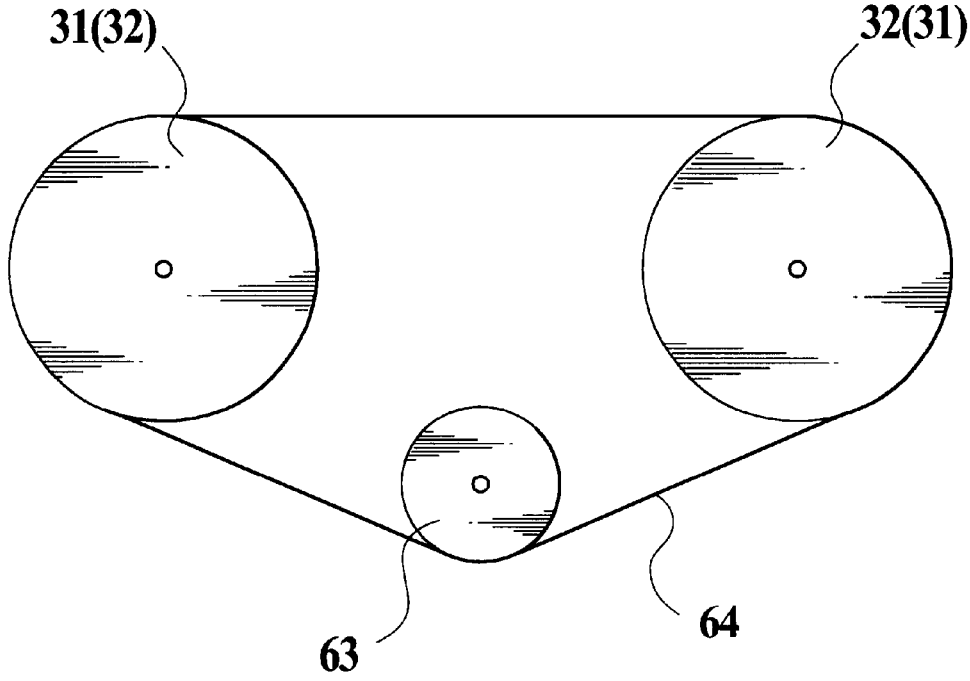
FIGS. 11A and 11B are plan views of a driving device according to a further embodiment of the wobbling toy of the present invention.
Figure 11B:
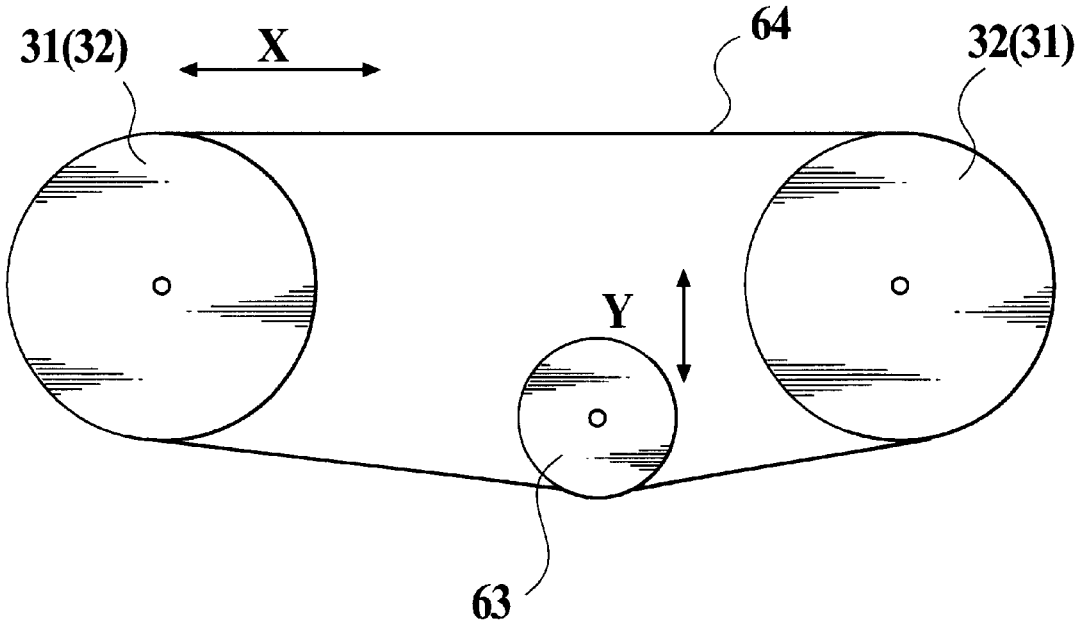

Further, it may have a structure which comprises the driving pulley 31, the driven pulley 32 and a tension pulley 63, as shown in FIGS. 11A and 11B. In the structure, at least one of the driving pulleys 31 and 32 can move reciprocally in the direction of the arrow X and is biased in the direction to separate the driving pulleys 31 and 32 to each other. The tension pulley 63 can move reciprocally in the direction of making a wrapping member 64 strain or loose, e.g., the direction of the arrow Y. Accordingly, at least one of the driving pulleys 31 and 32 is moved by the movement of the tension pulley 63.

The entire disclosure of Japanese Patent Application Nos. Tokugan 2000-143501 and Tokugan 2000-143502 which were filed on May 16, 2000, including specification, claims, drawings and summary are incorporated herein by reference in its entirety.

What is claimed is:

1. A wobbling toy comprising:

a body;

a shaft attached to the body; and a wheel which is rotatable around and attached to the shaft and tilted at an angle to a plane perpendicular to the shaft, to move the body, the wheel comprising a magnet, wherein the magnet of the wheel has an S-pole and an N-pole in a thickness direction of the wheel so that the wobbling toy can travel by a magnetic force exerted on the magnet of the wheel.

2. A wobbling toy comprising:

a body having an approximately symmetrical shape with respect to a plane, an axis of rotation, attached to the body in a direction approximately perpendicular to the plane of symmetry; and a wheel which is rotatable around the axis of rotation, for moving the body, wherein the wheel has an approximate rectangular section with a width enough to move the body stable by rotation of the wheel, and the wheel is attached to the axis of rotation to tilt at an angle to a plane perpendicular to the axis, wherein the body is divided into a plurality of parts, one of which is connected with a next part by a pivot, to swing approximately horizontally with respect to the next part.

3. The wobbling toy as claimed in claim 2, wherein the wheel comprises a magnet.

4. The wobbling toy as claimed in claim 3, wherein the wobbling toy travels due to a magnetic force exerted on the magnet of the wheel.

5. A wobbling toy set comprising:

a wobbling toy member comprising a first magnetic body, the first magnetic body comprising a magnetic wheel which has an S-pole and an N-pole in a thickness direction thereof, a shaft attached to the magnetic body, and a wheel which is rotatable around the shaft, for moving the body, wherein the wheel is attached to the shaft, to tilt at an angle to a plane perpendicular to the shaft; and a driving device comprising a driving first pulley, a second pulley driven by the first pulley, and a belt which is wrapped around the first and second pulleys, wherein a second magnetic body which exerts to the first magnetic body to move the wobbling toy member, is attached to the belt, the second magnetic body comprising a magnet which has an S-pole and an N-pole arranged in a direction approximately parallel to a surface on which the wobbling toy member travels.

6. A wobbling toy set as claimed in claim 5, wherein the driving device further comprises a reciprocal motor to drive the first pulley.

7. A wobbling toy set as claimed in claim 5, wherein the second magnetic body can be turned around a position on the belt according to a change of rotational direction of the belt to change magnetic poles of the second magnetic body.

8. A wobbling toy set as claimed in claim 5, wherein the driving device further comprises a moving member for moving one of the first and second pulleys to change a position of the one of the first and second pulleys with respect to the other.

9. A wobbling toy set as claimed in claim 5, wherein the body of the wobbling toy member is divided into a plurality of parts, one of which is connected with a next part by a pivot, to swing horizontally with respect to the next part.

10. A wobbling toy set as claimed in claim 5, wherein the wobbling toy member has a shape of an aquatic animal.

11. A wobbling toy set comprising:

a ground plate, a wobbling toy member provided on an upper surface of the ground plate, comprising a body, a shaft attached to the body, and a magnetic wheel which is rotatable around the shaft, for moving the body, wherein the magnetic wheel having an S-pole and an N-pole in a thickness direction thereof is attached out of perpendicular to the shaft, and a driving device provided under the ground plate, comprising a magnetic body which magnetically exerts to the magnetic wheel, and a transport member for transporting the magnetic body along a lower surface of the ground plate and along a desired transportation course.

12. A wobbling toy set as claimed in claim 11, wherein the magnetic body has a direction of N-pole to S-pole which is approximately parallel to the lower surface of the ground plate, and the direction of N-pole to S-pole of the magnetic body can be changed when a transportation direction for the transport member is reversed.

13. A wobbling toy set comprising:

a ground plate, wobbling toy means with a wheel, for moving forward on an upper surface of the ground plate and wobbling by rotation of the wheel, and rotating means for rotating the wheel of the wobbling toy means from under the ground plate.

* * * * *